US005651625A

United States Patent [19]

Smith et al.

[11] Patent Number: 5,651,625

[45] Date of Patent: Jul. 29, 1997

[54] PRINTER ENCLOSURE AND CONTROLLER UNIT

[75] Inventors: Charles C. Smith; Thomas R. Bernard, both of Baton Rouge, La.

[73] Assignee: Security Operating Systems, Inc., Baton Rouge, La.

[21] Appl. No.: 419,192

[22] Filed: Apr. 10, 1995

[51] Int. Cl.[6] ..... B41J 29/377

[52] U.S. Cl. ..... 400/691; 400/719; 361/695; 361/724; 101/416.1

[58] Field of Search ..... 400/624, 625, 400/629, 689, 690, 690.4, 691, 693, 719; 101/416.1, 424.1; 271/207; 347/101, 104, 108; 355/308, 309; 346/145; 312/208.1, 208.2, 223.1, 223.2, 223.3; 361/690, 694, 695, 724

[56] References Cited

U.S. PATENT DOCUMENTS

| | | | |
|---|---|---|---|
| 3,308,919 | 3/1967 | Cunningham | 400/690.4 |
| 4,600,326 | 7/1986 | Fudatsujk et al. | 361/695 |
| 4,626,048 | 12/1986 | Goodlander | 312/236 |
| 4,692,778 | 9/1987 | Yoshimura et al. | 346/145 |
| 4,698,650 | 10/1987 | Watanabe et al. | 347/108 |
| 4,893,137 | 1/1990 | Ebinuma et al. | 347/108 |
| 5,021,763 | 6/1991 | Obear | 340/407 |
| 5,401,092 | 3/1995 | Ady | 312/223.2 |
| 5,528,371 | 6/1996 | Ebisawa | 347/102 |

FOREIGN PATENT DOCUMENTS

| | | | |
|---|---|---|---|
| 4208822 | 7/1993 | Germany . | |
| 2-052776 | 2/1980 | Japan | 400/690.4 |
| 2-261686 | 10/1990 | Japan | 400/691 |
| 3-155972 | 7/1991 | Japan | 400/690 |
| 4-141481 | 5/1992 | Japan | 400/691 |

*Primary Examiner*—David A. Wiecking
*Attorney, Agent, or Firm*—John F. Sieberth

[57] ABSTRACT

"Smart" enclosure units which not only isolate electronic printers from the surrounding atmosphere but prevent explosion hazardous conditions from arising when retrieving output from the printers are described. The units comprise a first pressurizable chamber for housing an electronic printer which transforms received input electronic signals into printout copy which emerges from the printer; and a second pressurizable chamber contiguous with the first chamber for receiving, through a portal located between the chambers, printout copy from the printer as the printout copy emerges from the printer. The second chamber has a door enabling an operator to periodically remove printout copy from the second chamber. A closure for the portal when open permits printout copy to pass from the printer into the second chamber. When closed, this closure seals off the first chamber from the second chamber. A pressurized atmosphere of innocuous gas is maintained in the first and second chambers when the door is in closed position and the closure is open, and a pressurized atmosphere of innocuous gas is maintained in the first chamber when the closure is in closed position. Control means permits operation of the printer when the door is in closed position and the closure is open, but prevents operation of the printer when the door is open.

45 Claims, 8 Drawing Sheets

PRINTER ENCLOSURE AND CONTROLLER UNIT

TECHNICAL FIELD

This invention relates to enhancing the safety associated with the operation of electronic printers in environments in which potential explosion hazards may arise. More particularly, this invention relates to "smart" enclosure units which not only isolate electronic printers from the surrounding atmosphere but prevent hazardous conditions from arising when retrieving output from the printers.

BACKGROUND

There are many potentially hazardous situations in which it is necessary or desirable to receive information or data in the form of printout from electronic signals generated by a computer at a remote location. For example, the possibility exists in chemical plants, refineries, granaries, cement plants, paint factories, and other similar installations, that flammable vapors or finely-divided particles may become admixed in explosive proportions with the air in proximity to operating electronic printers. Where the printer is a laser printer, the potential hazards can become even more pronounced because of the high internal temperatures which are associated with the operation of such printers. Thus a need has arisen for an effective way of eliminating, or at least reducing, these potential hazardous conditions.

While enclosing the printer in an enclosure having an inert atmosphere can reduce some of the hazards, it becomes necessary from time to time to retrieve the printout from the printer. Thus a further need exists for a way of effectively enabling the removal of printout from an enclosed printer located in hazardous environments of the type referred to above.

SUMMARY OF THE INVENTION

This invention is deemed to fulfill the foregoing needs very effectively and very efficiently.

In accordance with one of its embodiments this invention provides a printer enclosure and controller unit which comprises:

a) a first pressurizable chamber for housing an electronic printer which during operation transforms received input electronic signals into printout copy which emerges from the printer;

b) a second pressurizable chamber contiguous with the first chamber for receiving through a portal disposed between these chambers printout copy from the printer as the printout copy emerges from the printer;

c) a closure for the portal which in an open position permits printout copy to pass from the printer into the second chamber, and which when in closed position seals off the first chamber from the second chamber;

d) a source of pressurized innocuous gas for maintaining a pressurized atmosphere of innocuous gas in the first and second chambers when the door is in closed position and the closure is open, and for maintaining a pressurized atmosphere of innocuous gas in the first chamber when the closure is in closed position; and e) control means permitting operation of the printer when the door is in closed position and the closure is open, and that prevents operation of the printer when the door is open.

Preferably, the control means of e) also prevents operation of the printer under circumstances wherein the closure is in closed position but the door is in an open position.

The term "innocuous gas" denotes that the gas within the chambers is non-hazardous from the standpoint of explosion hazards. Thus the gas employed can be nitrogen, argon, neon, or other so-called "inert gas". Preferably however the pressurized innocuous gas is "clean" air, e.g., air from a source that does not contain flammable gases or finely-divided particles in amounts anywhere near the explosive levels.

In a preferred embodiment, the control means includes sensing means which during operation of the printer senses the quantity of printout copy received through the portal and causes the control means to discontinue further operation of the printer when the quantity of printout copy sensed by the sensing means has reached a preselected quantity. For example, when the printout copy is in the form of individual sheets, the sensing means can be adapted to count and record the number of sheets sensed thereby and transmits a signal causing said control means to discontinue further operation of the printer when the number of sheets counted by said sensing means has reached a preselected number, such as 10, 50 or 100 sheets.

In accordance with another preferred embodiment the source of pressurized innocuous gas provides a continuous flow of innocuous gas into the second pressurizable chamber when the door is in an open position. A particularly preferred manner of accomplishing this is for the first and second pressurizable chambers to share a common wall therebetween, and to provide in that wall a small precision orifice extending therethrough such that under the conditions where (1) innocuous gas is continuously introduced into the first chamber to pressurize the same, (2) the closure is in closed position, and (3) the door is in an open position:

A) the orifice is the sole means for passage of innocuous gas from the first chamber into the second chamber, and B) the orifice is small enough to prevent rapid depletion of pressure in the first chamber but large enough to ensure a sufficient flow of innocuous gas into the second chamber to displace atmospheric gas tending to enter the second chamber.

In a particularly preferred embodiment the orifice is also large enough to ensure that the pressure in the first and second pressurizable chambers is rapidly equalized upon closing the door under the condition where (1) innocuous gas is continuously introduced into said first chamber to pressurize the same, and (2) the closure is in closed position.

While various suitable pressures can be employed in the system, it is desirable to regulate the pressure of pressurized atmosphere of innocuous gas in the first and second chambers when the door is in closed position and the closure is in an open position, and in the first chamber when the closure is in closed position, to pressure in the range equivalent to about 5 to about 15 inches of water column. However departures from this range are permissible in the practice of this invention.

An additional preferred embodiment of this invention is a unit in accordance with the foregoing wherein:

A) the unit is adapted to accommodate and operate a printer that includes a print buffer means and is operatively connectable to a remote computer having on-line and off-line modes of operation, wherein input electronic signals from the computer while operating in the on-line mode are received and transformed by the printer into printout copy and wherein further receipt by the printer of input electronic signals from the computer is interrupted when the computer is switched to the off-line mode of operation, but input electronic signals then present in the print buffer means can continue to be transformed into printout copy until the buffer means has been emptied of input electronic signals;

B) the control means includes sensing means which during operation of the printer senses the quantity of printout copy received through the portal, and when the quantity of printout copy sensed by the sensing means has reached a preselected quantity, the sensing means causes the control means (i) to switch the computer to the off-line mode of operation and (ii) to generate a closure signal when the buffer means has been emptied of input electronic signals and the printout copy thereof has been received in the second pressurized chamber;

C) the control means further includes closure control means for closing the closure in response to the closure signal; and D) the control means further includes signal means that provides a signal indicating:

1) that the buffer means has been emptied of input electronic signals, 2) that the input electronic signals formerly in the buffer mean have been transformed into printout copy received in the second pressurized chamber, 3) that the computer remains in the off-line mode of operation, and 4) that the closure is in condition to be placed in a closed position.

These and other embodiments, features and advantages of this invention will be still further apparent from the ensuing description, appended claims and accompanying drawings.

THE DRAWINGS

Figure 10A:
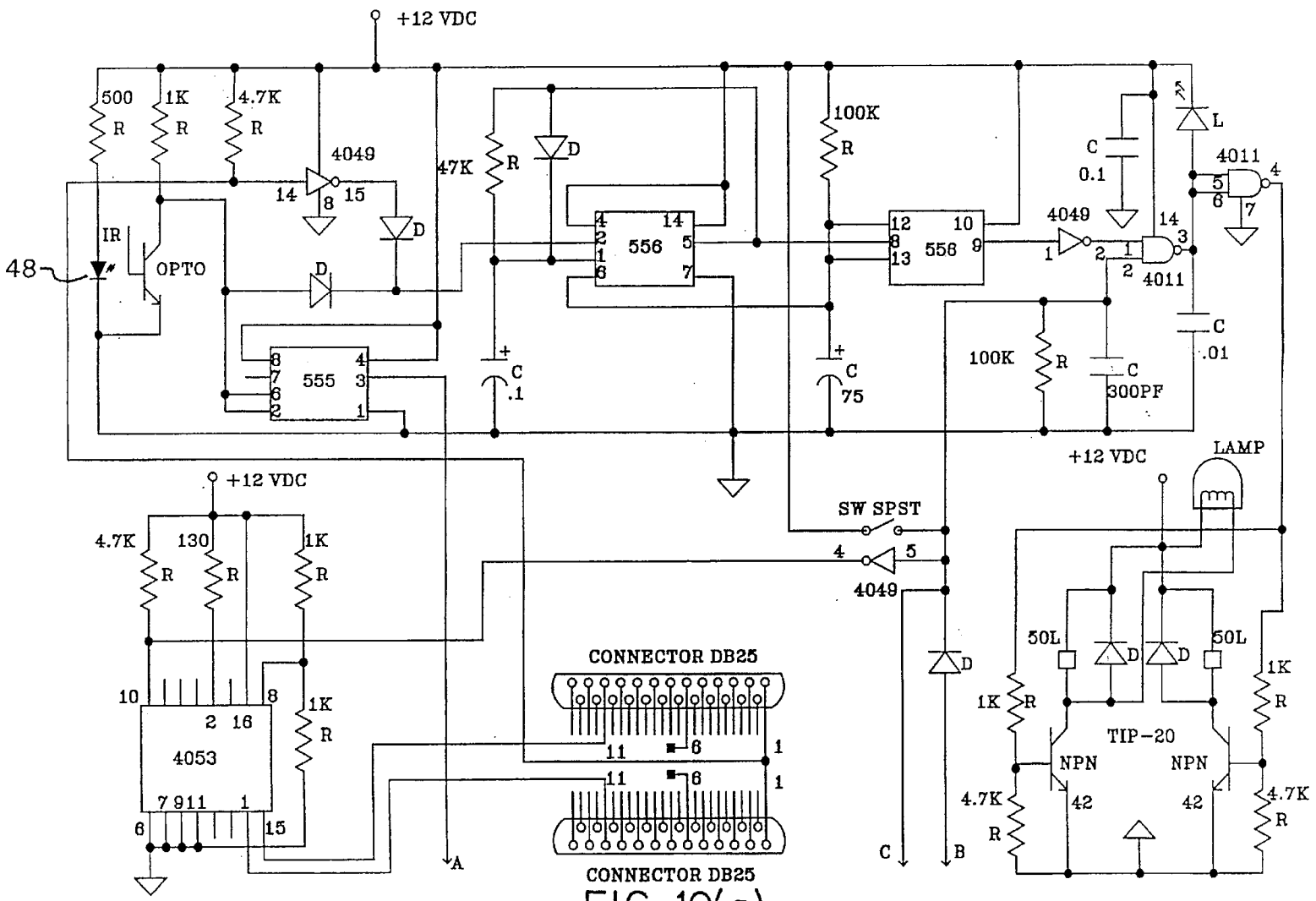
Figure 10B:
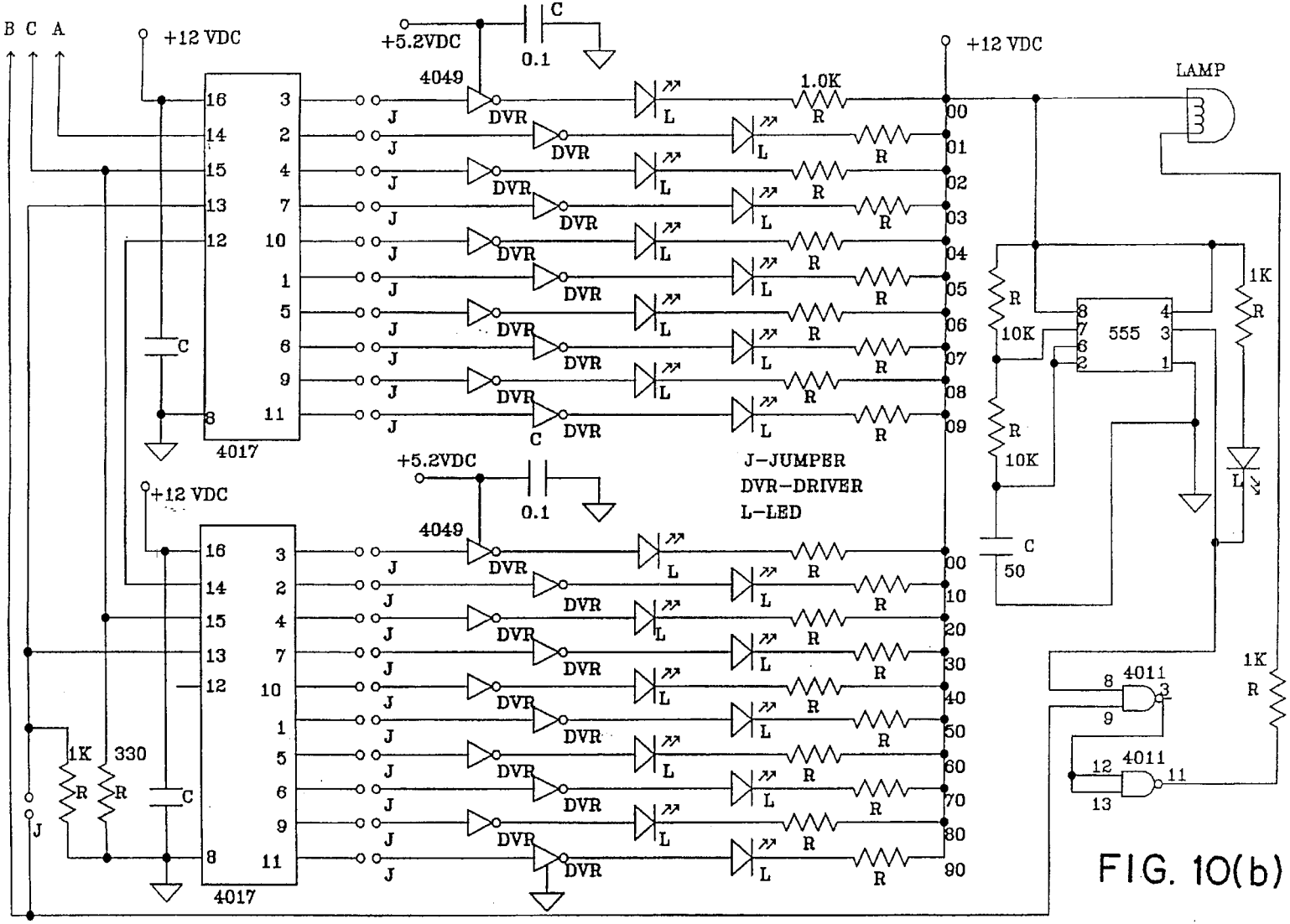

FIGS. 10A and 10B taken together constitute a diagram of preferred electronics of the control system—FIG. 10A depicts the logic of a preferred printer counter system and FIG. 10B depicts the logic of a preferred printer/computer control system for use in a unit of this invention.

Figure 11:
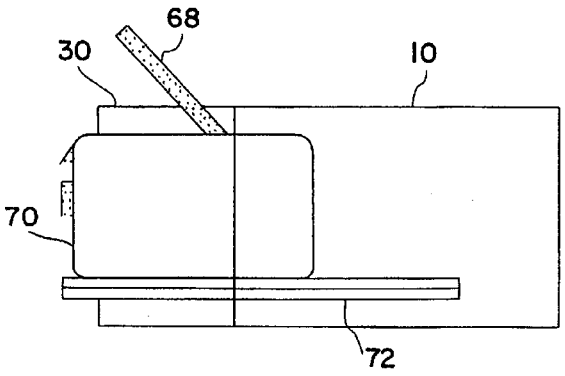

FIG. 11 is a side view of a unit of the invention depicted in a fully open position to enable access to a laser printer which is enclosed in the unit during actual service.

Figure 12:
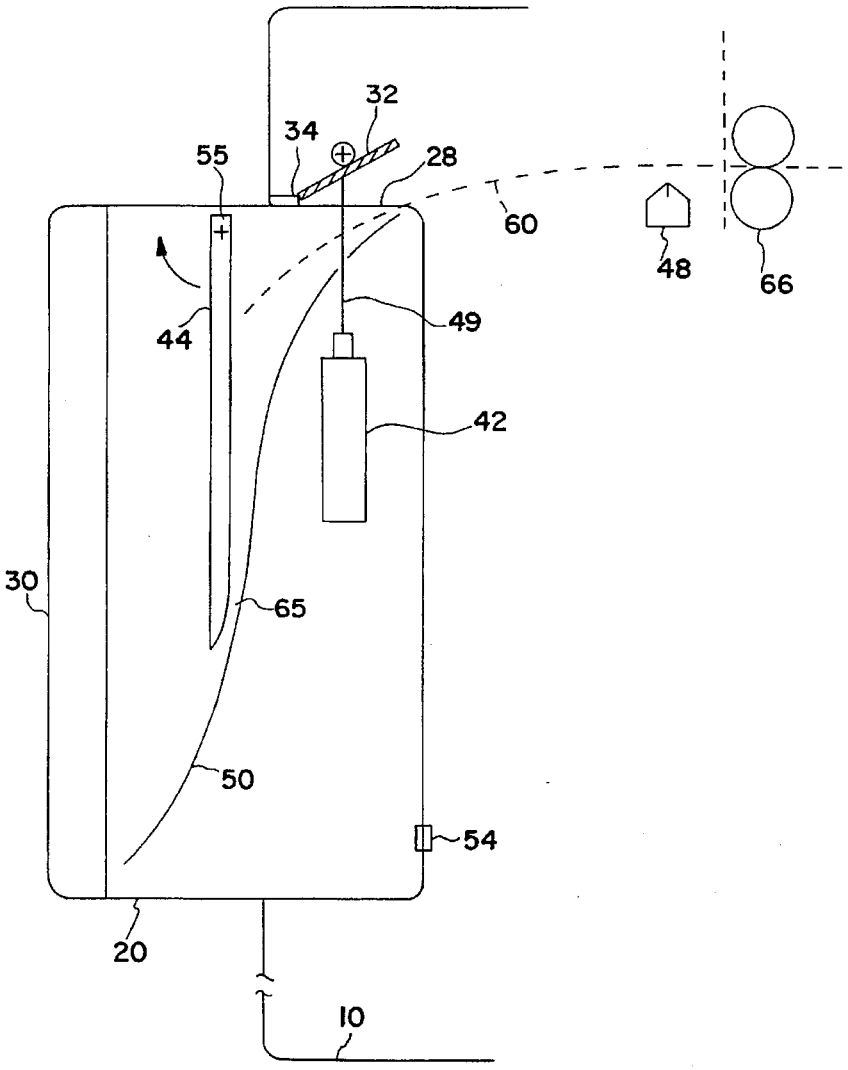

FIG. 12 is a side view depicting schematically the preferred construction within the second chamber for receiving the printout copy when in the form of individual sheets.

Figure 13:
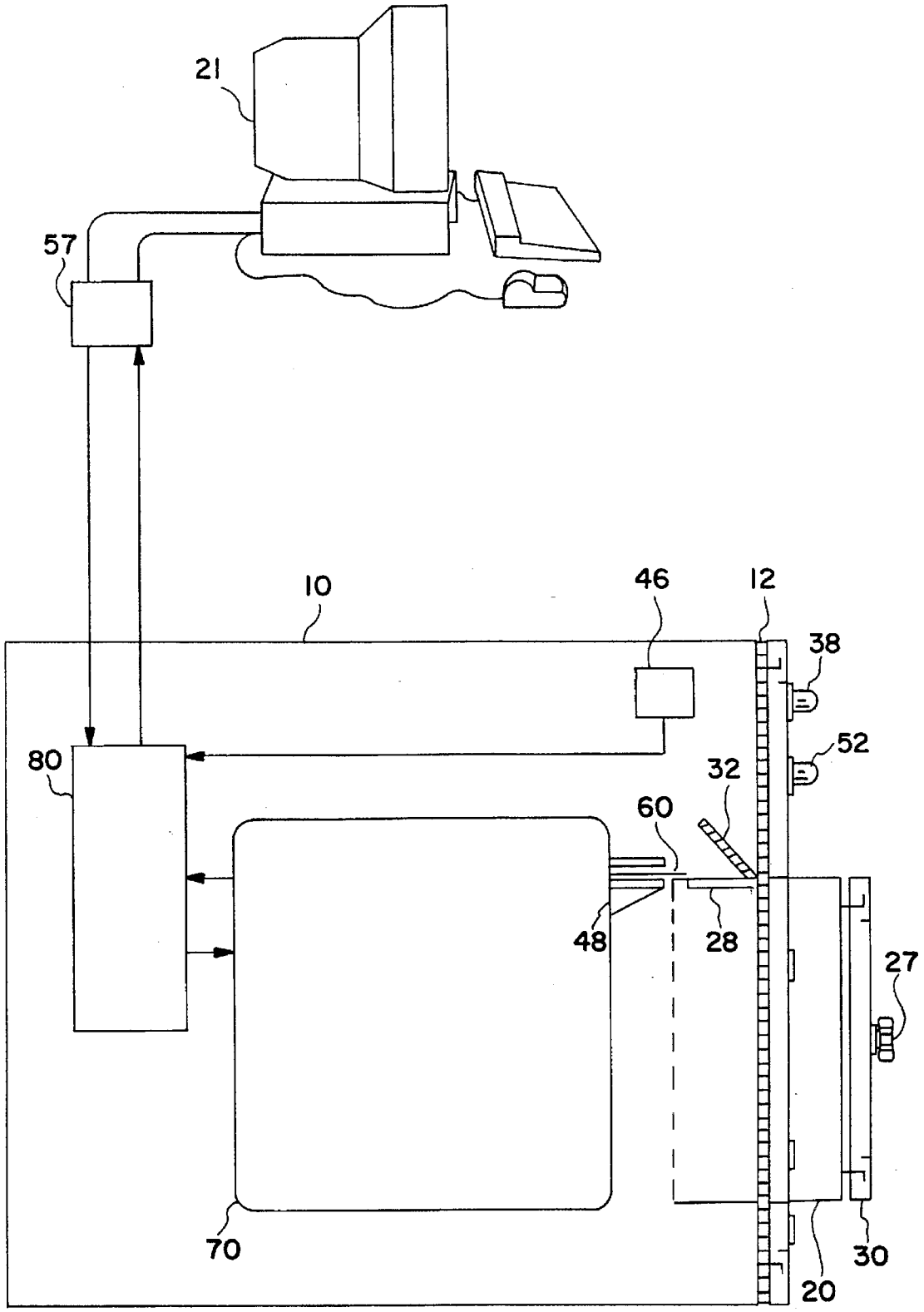

FIG. 13 illustrates the control logic of a preferred unit of this invention.

FURTHER DESCRIPTION OF PREFERRED EMBODIMENTS

Referring now to the drawings, wherein like numerals represent like parts among the several views, the preferred unit as depicted includes a housing composed of a first pressurizable chamber 10, a second pressurizable chamber 20 contiguous with chamber 10, and a door 30 in chamber 20 providing access to the interior of chamber 20. Chamber 20 is supported by and extends through panel 22 which in turn is connected vertically on one side to the front proximate side of chamber 10 by continuous hinge 12. Thus panel 22 and chamber 20 can be swung open or swung shut as a unit much like a door. When in closed position and latched by latches 24, panel 22 abuts the front edges of chamber 10 and the system is rendered pressurizable by a seal created by gasket 26 disposed around the entire interface between the front edges of chamber 10 and the back abutting face of panel 22. Gasket 26 is fabricated from a suitably strong, resilient and relatively gas impermeable material such as neoprene rubber. As seen from FIG. 11, when panel 22 is swung open, and electronic printer 70 such as a laser printer can be installed into chamber 10 or fully or partially removed from chamber 10 as needed by means of slider 72. Access to the interior of printer 70 is facilitated by access cover 68 typically provided on conventional printers.

Door 30 is connected vertically on one side to the front proximate side of chamber 20 by continuous hinge 25. When in closed position, door 30 is secured in place by latch 27.

Figure 1:
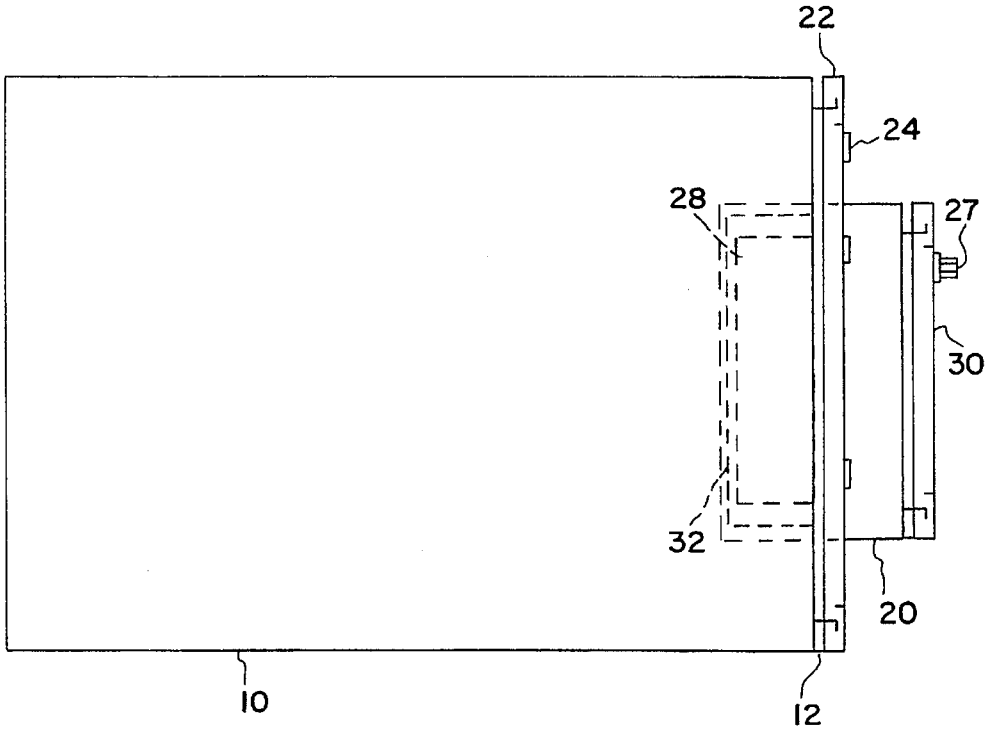
FIG. 1 is a top view of a preferred unit of this invention.
Figure 2:
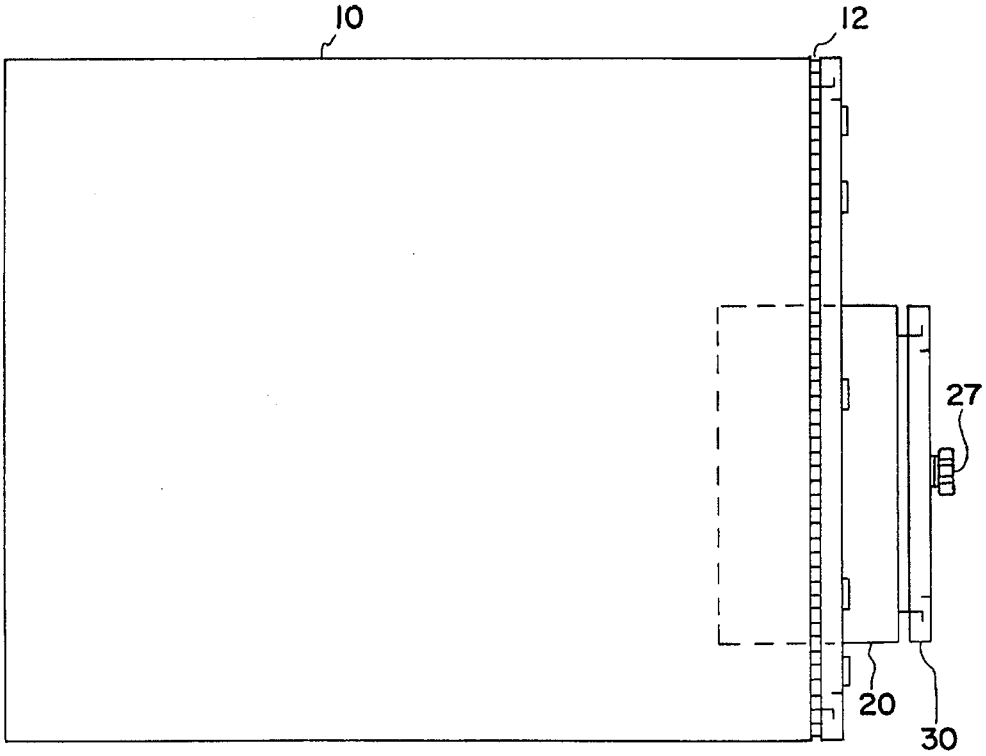
FIG. 2 is a side view of a preferred unit of this invention.
Figure 3:
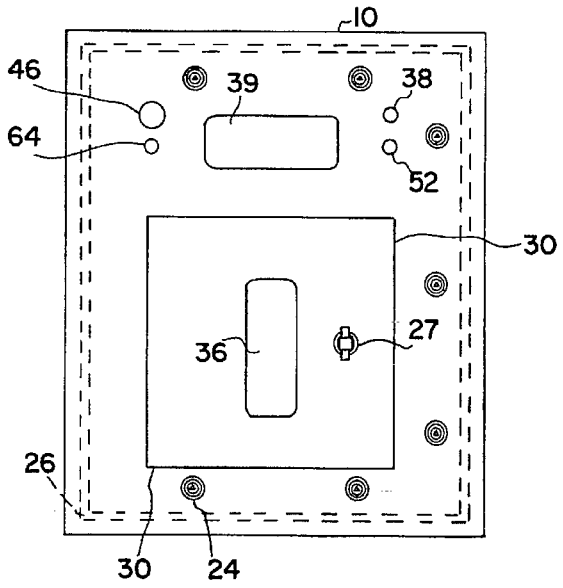
FIG. 3 is a front view of a preferred unit of this invention.
Figure 4:
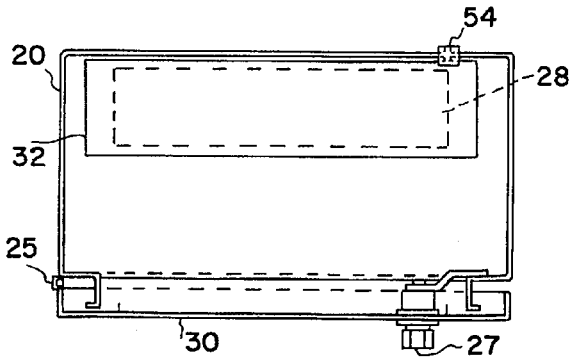
FIG. 4 is a plan view in section of the second chamber of a preferred unit of this invention.
Figure 5:
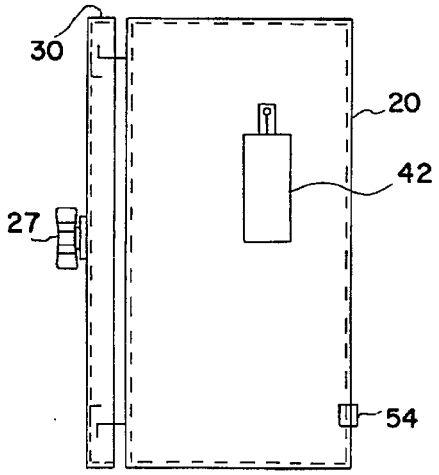
FIG. 5 is a side view in section of the second chamber of a preferred unit of this invention.
Figure 6:
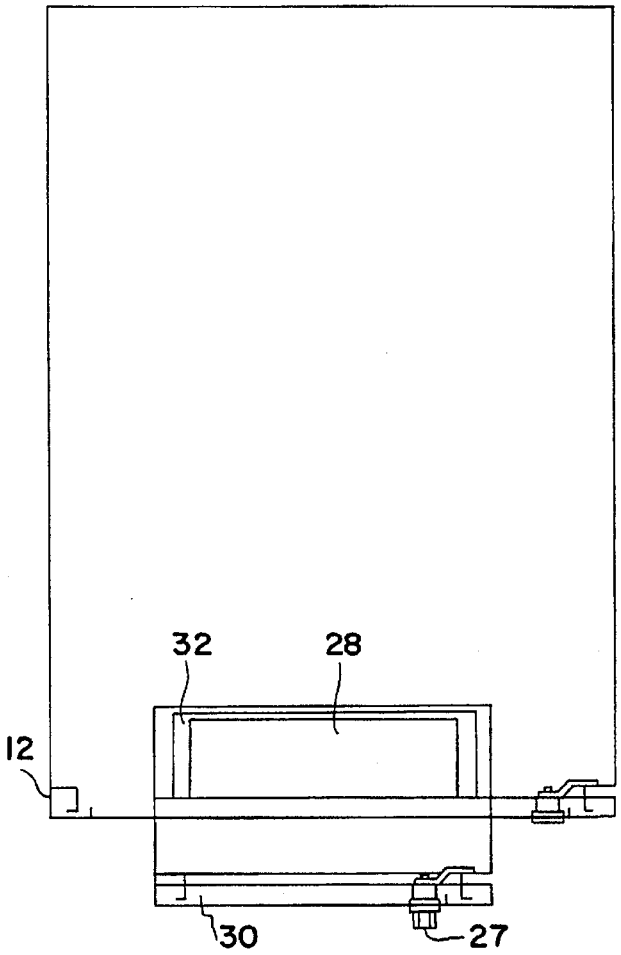
FIG. 6 is a plan view in section of a preferred unit of this invention depicting, inter alia, the disposition of latching and hinging elements therein.
Figure 7:
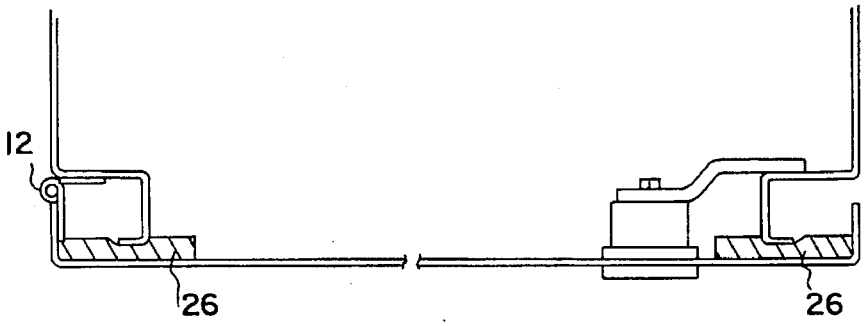
FIG. 7 is an enlarged view of construction details of the latching and hinging elements depicted in FIG. 6.
Figure 8:
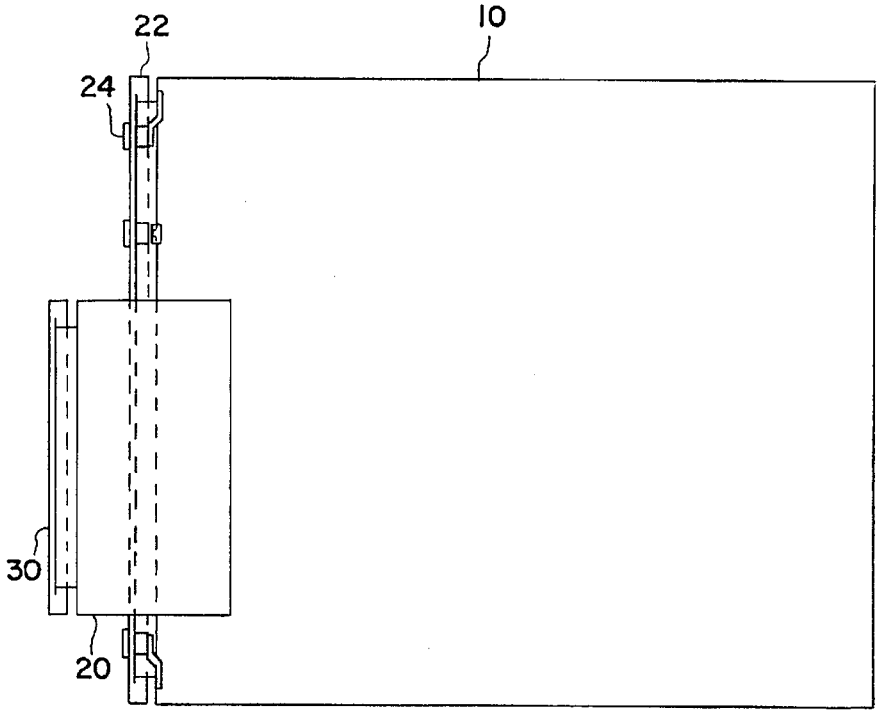
FIG. 8 is a side view in section of a preferred unit of this invention depicting, inter alia, the disposition of latching elements therein.
Figure 9:
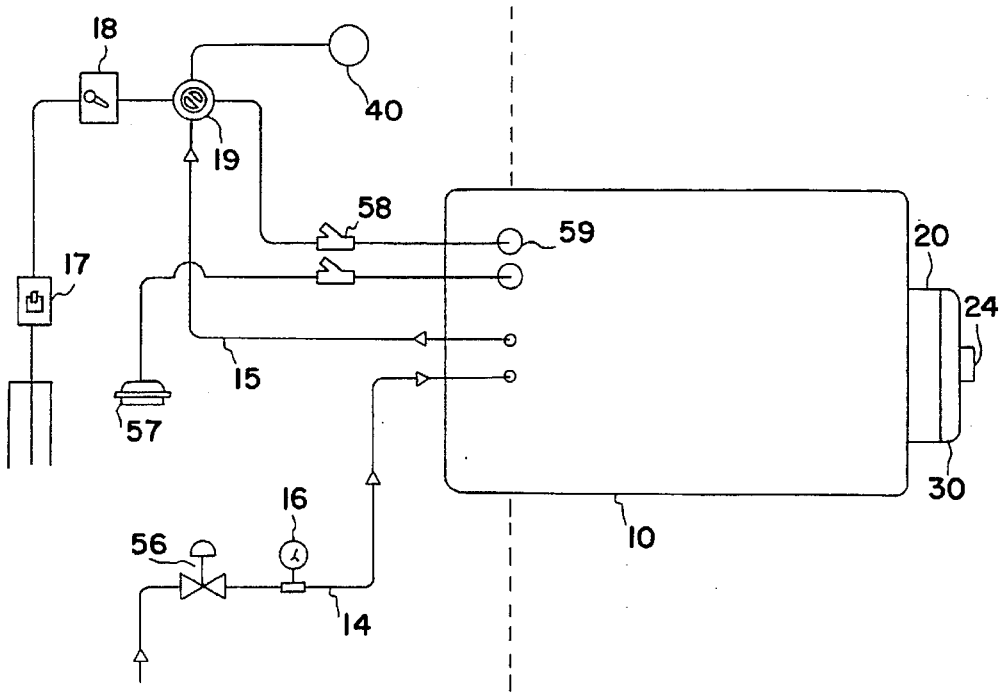
FIG. 9 is a schematic diagram of utilities associated with a preferred unit of this invention.

FIG. 9 depicts the utilities associated with the preferred unit under discussion. There are four major electrical connections to the unit, namely: (1) a 120 volt AC power connection to the unit, (2) connection from air pressure sensing within the unit to a pressure sensor switch, (3) connection from innocuous gas input regulator to the unit air pressure sensor, and (4) computer control lines. Preferably the 120 volt AC supply is applied to the unit through a 20 amp circuit breaker 17 to an explosion proof mercury on-off switch 18. When the switch is placed in the on position and the internal pressure as sensed within the unit is at the pre-selected proper pressure (e.g., 8 inches of water column), power will be applied automatically to the unit, and light 64 is illuminated. If for any reason the unit is not at the proper internal pressure, pressure sensor switch 19 will not allow electrical power to be applied to the unit. It will be seen from FIG. 9 that instrument air or other source of innocuous gas under pressure can be introduced into chamber 10 via input line 14 containing an air regulator or other pressure control mechanism 56 and a pressure gauge 16. Innocuous gas emanating from the unit is transported by line 15 to pressure sensor switch 19. Preferably the input innocuous gas is filtered for moisture content so that the moisture level is minimal. In the event there is an significant loss of pressure from the unit, pressure sensor 19 measuring pressure within chamber 10 actuates an alarm 40. To prevent atmospheric gases from entering the system, conduit seal 58 and enclosure conduit seal 59 are included in the unit. A 25-pin delta connector 57 provides an electrical connection a remote computer 21 (FIG. 13 only) from which the incoming signals to printer 70 originate.

In the preferred form depicted, the first chamber 10 and the second chamber 20 share a common vertical wall therebetween. To make possible a continuous flow of innocuous gas into chamber 20 when door 30 is in an open position, a small precision orifice 54 extends through this common wall. Thus under the set of conditions where (1) innocuous gas is continuously introduced into chamber 10 to pressurize the same, closure 32 is in closed position, and (3) door 30 is in an open position, orifice 54 is the sole means for passage of innocuous gas from chamber 10 into chamber 20, and the resultant flow of the innocuous gas into chamber 20 serves to maintain an innocuous atmosphere within the unit at all times thereby minimizing the potential explosion hazard. Accordingly, orifice 54 is large enough to ensure a sufficient flow of innocuous gas from chamber 10 to chamber 20 to displace atmospheric gas tending to enter chamber 20. But at the same time, orifice 54 is small enough to prevent rapid depletion of pressure in chamber 10. In particularly preferred embodiments, orifice 54 is also large enough to ensure that the pressure in the both chambers is rapidly equalized upon closing door 30 under the set of conditions where (1) innocuous gas is continuously introduced into chamber 10 to pressurize the same, and (2) closure 32 is in closed position. With a system operated under a pressure of 8 inches of water, excellent results in line with the foregoing are achieved when orifice 54 is approximately 1/32 inch in diameter. Larger and smaller dimensions for orifice 54 can of course be used, especially where the operating pressure of the system is higher or lower than 8 inches of water. In general, the higher the pressure, the smaller the orifice.

The top wall or ceiling of chamber 20 includes a portal 28 sized and located to allow printout copy emerging from the printer to pass into chamber 20. Closure 32 is located above and is sized and adapted to completely cover and seal off portal 28 when placed into its closed position on hinge 34 by means of solenoids 42 which are actuated by an incoming signal from the control unit described below. Closure 32 is preferably spring-loaded so that it tends to remain in an open position unless it is moved into closed position by the solenoids 42 and their links 49. It will be noted that the pressurized innocuous gas in chamber 10 assists in maintaining the sealing action of portal 28. Chamber 20 receives the printout as it emerges from the printer.

When in the form of individual sheets of paper or the like, the most preferred construction for receiving and stacking the paper is a free-fall system as depicted in FIG. 12. This system as depicted comprises an "S"-shaped panel 50 confronted by a stacker compression rod 44 which is pivotally suspended from the upper portion of chamber 20 and is at liberty to undergo a small amount of rotation at 55 as the sheet 60 emerging from the printer feed rolls 66 impinges upon the face of rod 44. As is depicted in FIG. 12, it is highly desirable for the lower face of rod 44 facing panel 50 to have a curved surface, as at 65, which generally follows the curvature of panel 50 in that proximate area. This provides for efficient vertical stacking of the sheets within the chamber. The stacked sheets can be readily removed upon opening door 30. To enable the interior of chamber 20 to be viewed by the operator, a window 36 is preferably included in door 30. To enable the printer 70 to be viewed from the exterior of the unit, it is preferred to include window 39 in panel 22. Closure 32 is placed in a closed position when on-line/off-line switch 46 is in the off-line position by means of solenoid 42 and link 49.

The details of the electronic componentry and circuitry causing the unit to be a "smart" enclosure are made clear in FIGS. 10A and 10B. In essence, the control unit simulates having an operator both on the remote computer that sends the incoming electronic signals to the printer and on the printer itself.

As may be seen from FIG. 13, to maintain the integrity of both computer 21 and printer 70 control unit 80 is inserted into the printer parallel cable between the computer 21 and printer 70. With control unit 80, the flow of print data from computer 21 can be stopped. In addition, by sensing whether or not printing is currently in progress, the depicted control unit will delay both the closing of closure 32 and the turn-on of a remove printout light 38 until printing of the current print data in the internal print buffer of printer 70 has been completed.

When printout removal is desired, the on-line/off-line switch 46 is transferred to the off-line position. This signals control unit 80 to condition the printer-busy control line for a "printer busy" condition which signals computer 21 to stop sending print data to printer 70, thereby taking computer 21 off-line with regard to transmission of print data.

While printing of sheets is in progress, an infrared emitter-detector 48 positioned in the path of the sheets that are being transferred to chamber 20 is functioning. Each time a sheet has passed through this detector, it transmits a signal to control unit 80 (schematically shown on FIGS. 10A and 10B). This signal in turn triggers or actuates a sheet counter (FIG. 10A) that counts the sheets as they pass through portal 28 into chamber 20. The sheet counter is preset for a predetermined limit, e.g., within the range of 10 to 100 sheets. When the sheet counter reaches the preset limit, it conditions control unit 80 to signal computer 21 to stop sending any additional print data. At this point, control unit 80 also turns on the hopper full light 52 and continues to monitor the signal from infrared emitter-detector 48 until the last sheet of the current print data is transferred into chamber 20. A delay timer on control unit 80 prevents closure 32 from closing and remove printout light 38 from coming on until a predetermined time (e.g., 15 seconds) after the last sheet has transferred from printer 70 into the chamber 20. After this delay condition is satisfied, control unit 80 energizes the solenoids 42 associated with closure 32, thus closing closure 32, and turns on the remove printout light 38.

After printouts have been removed from chamber 20, it is desirable to return the on-line/off-line switch 46 to the on-line position. This generates a signal to control unit 80 reset the sheet counter (FIG. 10B). It also turns off the hopper full light 52, de-energizes the solenoids 42 of closure 32 (thus opening closure 32 and making possible passage of additional printout from printer 70 through portal 28), and conditions the printer-busy control line so that a signal is transmitted to computer 21 to resume sending print data to printer 70 (i.e., placing computer 21 back on-line with regard to transmission of print data).

This invention is susceptible to considerable variation in its practice. Therefore the foregoing description is not intended to limit, and should not be construed as limiting, the invention to the particular forms of the invention described with reference to the Drawings. Rather, what is intended to be covered is as set forth in the ensuing claims and the equivalents thereof permitted as a matter of law.

What is claimed is as follows:

1. A printer enclosure and controller unit which comprises:

a) a first pressurizable chamber for housing an electronic printer which during operation thereof transforms received input electronic signals into printout copy which emerges from the printer;

b) a second pressurizable chamber contiguous with said first chamber for receiving through a portal disposed between said chambers printout copy from the printer as the printout copy emerges from the printer, said second chamber having a door having open and closed positions which in an open position permits removal of printout copy from said second chamber;

c) a closure for said portal having open and closed positions which in an open position permits printout copy to pass from the printer into said second chamber, and which in a closed position seals off said first chamber from said second chamber;

d) a source of pressurized innocuous gas for maintaining a pressurized atmosphere of innocuous gas in said first and second chambers when said door is in closed position and said closure is in an open position, and for maintaining a pressurized atmosphere of innocuous gas in said first chamber when said closure is in closed position; and e) control means permitting operation of the printer when said door is in closed position and said closure is in an open position, and that prevents operation of the printer when said door is in an open position.

2. A unit in accordance with claim 1 wherein said control means prevents operation of the printer under circumstances wherein said closure is in closed position but said door is in an open position.

3. A unit in accordance with claim 1 wherein said control means includes sensing means which during operation of the printer senses the quantity of printout copy received through said portal and causes said control means to discontinue further operation of the printer when the quantity of printout copy sensed by the sensing means has reached a preselected quantity.

4. A unit in accordance with claim 3 wherein said printout copy is in the form of individual sheets and wherein said sensing means counts the number of sheets sensed thereby and transmits a signal causing said control means to discontinue further operation of the printer when the number of sheets counted by said sensing means has reached a preselected number.

5. A unit in accordance with claim 1 wherein said source of pressurized innocuous gas provides a continuous flow of innocuous gas into said second pressurizable chamber when said door is in an open position.

6. A unit in accordance with claim 5 wherein said control means prevents operation of the printer under circumstances wherein said closure is in closed position but said door is in an open position.

7. A unit in accordance with claim 5 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

8. A unit in accordance with claim 7 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

9. A unit in accordance with claim 1 wherein the pressure of pressurized atmosphere of innocuous gas in said first and second chambers when said door is in closed position and said closure is in an open position, and in said first chamber when said closure is in closed position is in the range equivalent to about 5 to about 15 inches of water column.

10. A unit in accordance with claim 1 wherein said pressurized innocuous gas is clean air.

11. A unit in accordance with claim 1 wherein:

A) said unit is adapted to accommodate and operate a printer that includes print buffer means and is operatively connectable to a remote computer having on-line and off-line modes of operation, wherein input electronic signals from the computer while operating in the on-line mode are received and transformed by the printer into printout copy and wherein further receipt by the printer of input electronic signals from the computer is interrupted when the computer is switched to the off-line mode of operation, but input electronic signals then present in the print buffer means can continue to be transformed into printout copy until said buffer means has been emptied of input electronic signals;

B) said control means includes sensing means which during operation of the printer senses the quantity of printout copy received through said portal, and when the quantity of printout copy sensed by the sensing means has reached a preselected quantity, said sensing means causes said control means (i) to switch the computer to the off-line mode of operation and (ii) to generate a closure signal when said buffer has been emptied of input electronic signals and the printout copy thereof has been received in said second pressurized chamber;

C) said control means further includes closure control means for closing said closure in response to said closure signal; and D) said control means further includes signal means that provides a signal indicating:

1) that said buffer has been emptied of input electronic signals, 2) that the input electronic signals formerly in said buffer means have been transformed into printout copy received in said second pressurized chamber, 3) that the computer remains in the off-line mode of operation, and 4) that said closure is in condition to be placed in a closed position.

12. A unit in accordance with claim 11 wherein said printout copy is in the form of individual sheets.

13. A unit in accordance with claim 11 wherein said source of pressurized innocuous gas provides a continuous flow of innocuous gas into said second pressurizable chamber when said door is in an open position.

14. A unit in accordance with claim 13 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

15. A unit in accordance with claim 14 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

16. A unit in accordance with claim 7 wherein said pressurized innocuous gas is clean air, and wherein the pressure of pressurized atmosphere of clean air in said first and second chambers when said door is in closed position and said closure is in an open position, and in said first chamber when said closure is in closed position is in the range equivalent to about 5 to about 15 inches of water column.

17. A unit in accordance with claim 10 wherein said source of pressurized innocuous gas is a source of pressurized clean air that provides a continuous flow of clean air into said second pressurizable chamber when said door is in an open position.

18. A unit in accordance with claim 17 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

19. A unit in accordance with claim 18 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

20. A unit in accordance with claim 19 wherein said printout copy is in the form of individual sheets.

21. Electrically powered printing apparatus which comprises:

a) an electronic printer which during operation thereof transforms received input electronic signals into printout copy which emerges from the printer;

b) a first pressurizable chamber for housing said printer;

c) a second pressurizable chamber contiguous with said first chamber for receiving through a portal disposed between said chambers printout copy from the printer as the printout copy emerges from the printer, said second chamber having a door having open and closed positions which in an open position permits removal of printout copy from said second chamber;

d) a closure for said portal having open and closed positions which in an open position permits printout copy to pass from the printer into said second chamber, and which in a closed position seals off said first chamber from said second chamber;

e) a source of pressurized innocuous gas for maintaining a pressurized atmosphere of innocuous gas in said first and second chambers when said door is in closed position and said closure is in an open position, and for maintaining a pressurized atmosphere of innocuous gas in said first chamber when said closure is in closed position; and f) control means permitting operation of the printer when said door is in closed position and said closure is in an open position, and that prevents operation of the printer when said door is in an open position.

22. Apparatus in accordance with claim 21 wherein said control means prevents operation of the printer under circumstances wherein said closure is in closed position but said door is in an open position.

23. Apparatus in accordance with claim 21 wherein said control means includes sensing means which during operation of the printer senses the quantity of printout copy received through said portal and causes said control means to discontinue further operation of the printer when the quantity of printout copy sensed by the sensing means has reached a preselected quantity.

24. Apparatus in accordance with claim 23 wherein said printout copy is in the form of individual sheets and wherein said sensing means counts the number of sheets sensed thereby and transmits a signal causing said control means to discontinue further transmission of electronic signals from the computer when the number of sheets counted by said sensing means has reached a preselected number.

25. Apparatus in accordance with claim 21 wherein said source of pressurized innocuous gas provides a continuous flow of innocuous gas into said second pressurizable chamber when said door is in an open position.

26. Apparatus in accordance with claim 25 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

27. Apparatus in accordance with claim 26 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

28. Apparatus in accordance with claim 21 wherein said control means further includes pressure sensing means and a power cutoff switch, wherein said pressure sensing means senses the pressure of the atmosphere in said first and second chambers when said door is in closed position and said closure is in an open position, and senses the pressure of the atmosphere in said first chamber when said closure is in closed position, said pressure sensing means producing a pressure-low signal in any case where said pressure falls below a preselected pressure, and wherein said power cutoff switch turns off the electrical power to said apparatus in response to said pressure-low signal.

29. Apparatus in accordance with claim 21 wherein the pressure of pressurized atmosphere of innocuous gas in said first and second chambers when said door is in closed position and said closure is in an open position, and in said first chamber when said closure is in closed position is in the range equivalent to about 5 to about 15 inches of water column.

30. Apparatus in accordance with claim 21 wherein said pressurized innocuous gas is clean air.

31. Apparatus in accordance with claim 21 wherein:

said printer includes print buffer means and is operatively connected to a remote computer having on-line and off-line modes of operation, wherein input electronic signals from the computer while operating in the on-line mode are received and transformed by the printer into printout copy and wherein further receipt by the printer of input electronic signals from the computer is interrupted when the computer is switched to the off-line mode of operation, but input electronic signals then present in the print buffer means can continue to be transformed into printout copy until said buffer has been emptied of input electronic signals;

B) said control means includes sensing means which during operation of the printer senses the quantity of printout copy received through said portal, and when the quantity of printout copy sensed by the sensing means has reached a preselected quantity, said sensing means causes said control means (i) to switch the computer to the off-line mode of operation and (ii) to generate a closure signal when said buffer has been emptied of input electronic signals and the printout copy thereof has been received in said second pressurized chamber;

C) said control means further includes closure control means for closing said closure in response to said closure signal; and D) said control means further includes signal means that provides a signal indicating:

1) that said buffer has been emptied of input electronic signals, 2) that the input electronic signals formerly in said buffer have been transformed into printout copy received in said second pressurized chamber, 3) that the computer remains in the off-line mode of operation, and 4) that said closure is in condition to be placed in closed position.

32. Apparatus in accordance with claim 31 wherein said source of pressurized innocuous gas provides a continuous flow of innocuous gas into said second pressurizable chamber when said door is in an open position.

33. Apparatus in accordance with claim 32 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

34. Apparatus in accordance with claim 33 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

35. Apparatus in accordance with claim 31 wherein said control means further includes pressure sensing means and a power cutoff switch, wherein said pressure sensing means senses the pressure of the atmosphere in said first and second chambers when said door is in closed position and said closure is in an open position, and senses the pressure of the atmosphere in said first chamber when said closure is in closed position, said pressure sensing means producing a pressure-low signal in any case where said pressure falls below a preselected pressure, and wherein said power cutoff switch turns off the electrical power to said apparatus in response to said pressure-low signal.

36. Apparatus in accordance with claim 35 wherein said source of pressurized innocuous gas provides a continuous flow of innocuous gas into said second pressurizable chamber when said door is in an open position.

37. Apparatus in accordance with claim 36 wherein said first and second pressurizable chambers share a common wall therebetween, wherein said wall has a small precision orifice therethrough such that under the condition where (1) innocuous gas is continuously introduced into said first chamber to pressurize the same, (2) said closure is in closed position, and (3) said door is in an open position:

a) said orifice is the sole means for passage of innocuous gas from said first chamber into said second chamber, and b) said orifice is small enough to prevent rapid depletion of pressure in the first chamber but large enough to ensure a sufficient flow of innocuous gas into said second chamber to displace atmospheric gas tending to enter said second chamber.

38. Apparatus in accordance with claim 37 wherein said orifice is also large enough to ensure that the pressure in said first and second pressurizable chambers is rapidly equalized upon closing said door under the condition where (1) innocuous gas is continuously introduced into said first chamber to pressurize the same, and (2) said closure is in closed position.

39. Apparatus in accordance with claim 31 wherein said printout copy is in the form of individual sheets.

40. Apparatus in accordance with claim 31 wherein said source of pressurized innocuous gas is a source of pressurized clean air, and wherein the pressure of pressurized atmosphere of clean air in said first and second chambers when said door is in closed position and said closure is in an open position, and in said first chamber when said closure is in closed position is in the range equivalent to about 5 to about 15 inches of water column.

41. Apparatus in accordance with claim 40 wherein said source of pressurized clean air provides a continuous flow of clean air into said second pressurizable chamber when said door is in an open position.

42. Apparatus in accordance with claim 41 wherein said first and second pressurizable chambers share a common wall therebetween, wherein said wall has a small precision orifice therethrough such that under the condition where (1) clean air is continuously introduced into said first chamber to pressurize the same, (2) said closure is in closed position, and (3) said door is in an open position:

a) said orifice is the sole means for passage of clean air from said first chamber into said second chamber, and b) said orifice is small enough to prevent rapid depletion of pressure in the first chamber but large enough to ensure a sufficient flow of clean air into said second chamber to displace atmospheric gas tending to enter said second chamber.

43. Apparatus in accordance with claim 42 wherein said orifice is also large enough to ensure that the pressure in said first and second pressurizable chambers is rapidly equalized upon closing said door under the condition where (1) the clean air is continuously introduced into said first chamber to pressurize the same, and (2) said closure is in closed position.

44. Apparatus in accordance with claim 41 wherein said control means further includes pressure sensing means and a power cutoff switch, wherein said pressure sensing means senses the pressure of the atmosphere in said first and second chambers when said door is in closed position and said closure is in an open position, and senses the pressure of the atmosphere in said first chamber when said closure is in closed position, said pressure sensing means producing a pressure-low signal in any case where said pressure falls below a preselected pressure, and wherein said power cutoff switch turns off the electrical power to said apparatus in response to said pressure-low signal, and wherein said printout copy is in the form of individual sheets.

45. Apparatus in accordance with claim 43 wherein said control means further includes pressure sensing means and a power cutoff switch, wherein said pressure sensing means senses the pressure of the atmosphere in said first and second chambers when said door is in closed position and said closure is in an open position, and senses the pressure of the atmosphere in said first chamber when said closure is in closed position, said pressure sensing means producing a pressure-low signal in any case where said pressure falls below a preselected pressure, and wherein said power cutoff switch turns off the electrical power to said apparatus in response to said pressure-low signal, and wherein said printout copy is in the form of individual sheets.

* * * * *

UNITED STATES PATENT AND TRADEMARK OFFICE

CERTIFICATE OF CORRECTION

PATENT NO. : 5,651,625

DATED : July 29, 1997

INVENTOR(S) : Charles C. Smith and Thomas R. Bernard

It is certified that error appears in the above-identified patent and that said Letters Patent are hereby corrected as shown below:

On the title page, under References Cited, U.S. Patent Documents, the last U.S. patent listed reads "5,528,371" and should read --5,528,271--.

Column 3, line 22, reads "mean" and should read --means--.

Column 4, line 53, reads "connection" and should read --connection to--.

Column 5, line 59, reads "printer 70 control" and should read -- printer 70, control--.

Claim 11, Column 8, line 23, reads "buffer" and should read -- buffer means--.

Claim 11, Column 8, line 32, reads "buffer" and should read --buffer means--.

Claim 31, Column 11, line 2, reads "said" and should read -- A) said--.

Claim 31, Column 11, each of lines 13, 20, 29 and 32, reads "buffer" and should read --buffer means--.

Signed and Sealed this

Second Day of December, 1997

*Attest:*

Bruce Lehman

BRUCE LEHMAN

*Attesting Officer*

*Commissioner of Patents and Trademarks*